US006665983B1

(12) United States Patent
Zimmerman et al.

(10) Patent No.: US 6,665,983 B1
(45) Date of Patent: Dec. 23, 2003

(54) LOCKABLE SLIDING WINDOW APPARATUS

(76) Inventors: Fred L. Zimmerman, 4151 Iowa Ter., Ottawa, KS (US) 66067; Blair Sutton, P.O. Box 418, Ottawa, KS (US) 66067

( * ) Notice: Subject to any disclaimer, the term of this patent is extended or adjusted under 35 U.S.C. 154(b) by 0 days.

(21) Appl. No.: 10/191,837

(22) Filed: Jul. 9, 2002

(51) Int. Cl.[7] ..... E05B 55/00

(52) U.S. Cl. ..... 49/449; 49/413; 49/25; 70/278.1

(58) Field of Search ..... 49/449, 458, 404, 49/503, 25, 413; 70/278.1, 278.7, 283, 386, 90, 25

(56) References Cited

U.S. PATENT DOCUMENTS

| | | | | | |
|---|---|---|---|---|---|
| 3,479,769 | A | * | 11/1969 | Diack | 49/449 |
| 3,667,263 | A | | 6/1972 | Rogers | |
| 4,008,465 | A | | 2/1977 | LeDoux | |
| 4,170,885 | A | * | 10/1979 | Lundgren | 70/97 |
| 4,205,325 | A | | 5/1980 | Haygood et al. | |
| 4,755,823 | A | | 7/1988 | Ohe et al. | |
| 4,759,575 | A | * | 7/1988 | McKnight | 292/144 |
| 4,895,009 | A | | 1/1990 | Kleefeldt et al. | |
| 5,109,684 | A | | 5/1992 | Grandy, Sr. | |
| 5,172,520 | A | | 12/1992 | Hostetler et al. | |
| 5,209,018 | A | * | 5/1993 | Heinrich | 49/449 |
| 5,609,051 | A | * | 3/1997 | Donaldson | 70/278 |
| 6,031,465 | A | | 2/2000 | Burgess | |
| 6,084,317 | A | | 7/2000 | Wolfe et al. | |
| 6,191,682 | B1 | | 2/2001 | Wolfgang | |

* cited by examiner

*Primary Examiner*—Jerry Redman
(74) *Attorney, Agent, or Firm*—Dale J. Ream

(57) ABSTRACT

A lockable sliding window apparatus includes sliding window units having respective vertical frame members that are coupled at a closed configuration. Inner and outer segments of one frame member receive the other frame member therebetween. A combination dial lock is mounted to the outer segment and includes a lock pin extending through therethrough. The lock pin is immovable when the combination lock is locked and vice versa. A window pin extends through the outer segment of the one frame member and through the other frame member for locking the other frame member in place. When the combination lock is unlocked, the lock pin may be user actuated to release the window pin for opening the window units. Another embodiment includes an electronic keypad by which a user may enter a security code. Proper entry actuates a solenoid to retract a lack pin that may otherwise lock the window units together.

20 Claims, 9 Drawing Sheets

LOCKABLE SLIDING WINDOW APPARATUS

BACKGROUND OF THE INVENTION

This invention relates generally to window locks and, more particularly to a locking apparatus for slidable windows such as horizontally slidable rear truck windows.

Keys are occasionally inadvertently locked in a vehicle, requiring the vehicle operator to retrieve another set of keys or obtain the services of a locksmith. On other occasions, however, an operator may desire to intentionally lock his keys in the vehicle so as not to have to carry them, e.g. while swimming at a beach or pool.

Therefore, it would be desirable to have a lockable sliding window apparatus that would enable an operator to open the window upon entering a correct code. Further, it is desirable to have a lockable sliding window apparatus which does not require a user to carry any operating hardware.

SUMMARY OF THE INVENTION

A lockable sliding window apparatus according to the present invention includes a window frame with a pair of window units mounted therein, at least one of the window units being slidable. Each window unit includes a vertical frame member having a configuration for mating engagement when the window units are in a closed configuration. A locking assembly is coupled to the vertical frame members and includes primary and secondary portions. The primary portion includes a combination dial lock mounted to an outer segment of one vertical frame member and includes dials which may be manipulated by a user to enter an appropriate unlock code. The combination dial lock includes a window pin which extends through the outer segment but is immovable when the combination dial lock is locked. The secondary portion of the locking assembly is mounted to an inner segment of the one vertical frame member and includes a window pin extending through corresponding through-holes of the vertical frame members of both window units. Therefore, the window pin holds/locks the pair of window units in the closed configuration. The window units may be selectively released when the combination dial lock is unlocked so that a user may depress the lock pin to urge the window pin out of its blocking position in the through-holes. Alternatively, the locking assembly may include a radio frequency identification (RFID) module capable of electromagnetically recognizing a properly coded tag and, correspondingly, actuating a solenoid to unlock the window units.

Therefore, a general object of this invention is to provide a lockable sliding window apparatus for selectively locking horizontally slidable windows against unauthorized entry.

Another object of this invention is to provide a lockable sliding window apparatus, as aforesaid, having a combination dial lock for enabling slidable window units to be opened from the outside upon entry of an appropriate combination code.

Still another object of this invention is to provide a lockable sliding window apparatus, as aforesaid, having a release tab mounted to the interior of the window units for enabling the window units to be slidably opened from the inside without respect to the combination dial lock configuration.

Yet another object of this invention is to provide a lockable sliding window apparatus, as aforesaid, which may be manufactured as an original equipment or after-market apparatus for use in vehicles.

A further object of this invention is to provide a lockable sliding window apparatus, as aforesaid, which utilizes a radio frequency identification module as the window locking mechanism.

Other objects and advantages of this invention will become apparent from the following description taken in connection with the accompanying drawings, wherein is set forth by way of illustration and example, embodiments of this invention.

DESCRIPTION OF THE PREFERRED EMBODIMENTS

Figure 1:
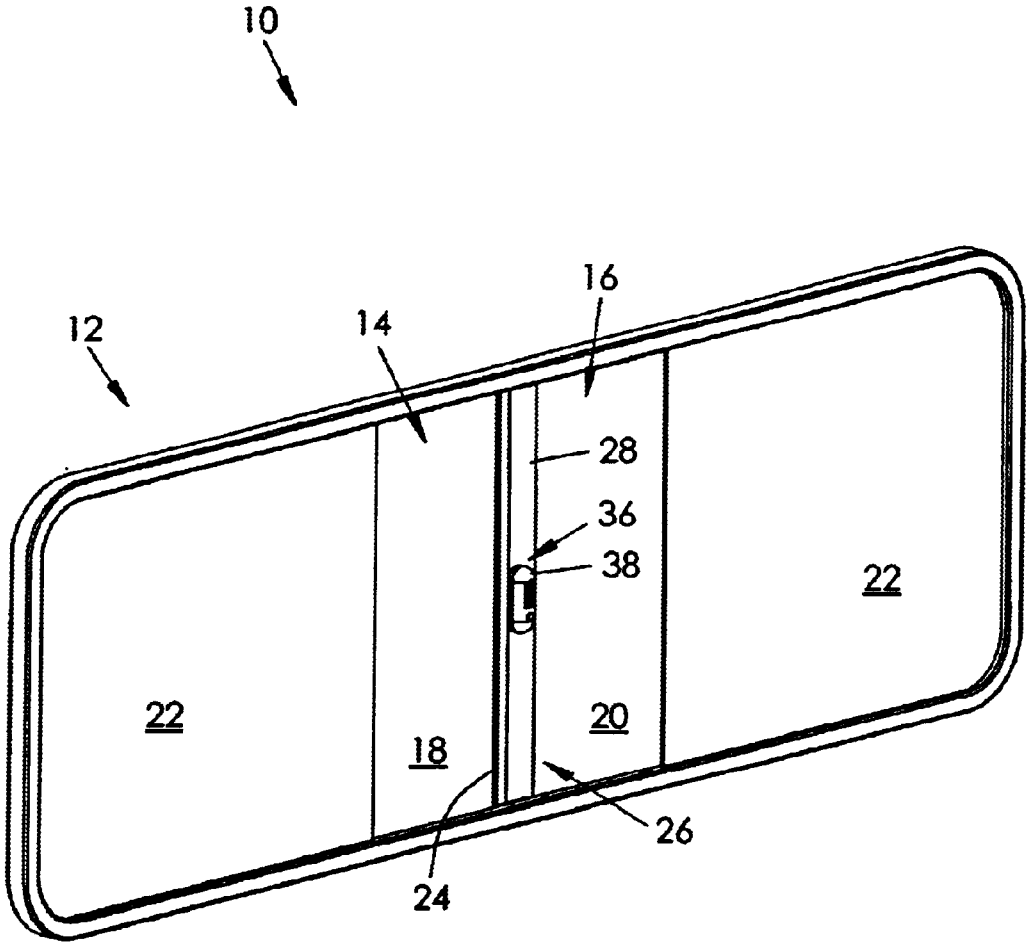
FIG. 1 is a perspective view of a lockable sliding window apparatus according to one embodiment of the present invention with the window units in a closed configuration.

A lockable sliding window apparatus according to the present invention will now be described in detail with reference to FIGS. 1 through 9B of the accompanying drawings.

A lockable sliding window apparatus 10 according to one embodiment of the present invention is shown in FIGS. 1 through 5B and includes a window frame 12 having a generally rectangular configuration suitable to be mounted in an opening for the rear window of a pickup truck. However, this apparatus 10 may be utilized in other window applications and therefore may have any other suitable configuration. First 14 and second 16 window units are mounted within the window frame 12 (FIG. 2A). The first 14 and second 16 window units include respective secondary frames in which respective window panels 18, 20 are mounted, each window panel being a pane of glass or transparent plastic. Longitudinally extending segments of the window frame 12 include a guide rail 13 on which at least the first window unit 14 is mounted on the guide rail 13 for horizontal slidable movement therealong although both the first 14 and second 16 window units are preferably slidably mounted for movement therealong (FIG. 2A). Of course, the window frame 12 may include other stationary window panes 22.

Figure 2B:
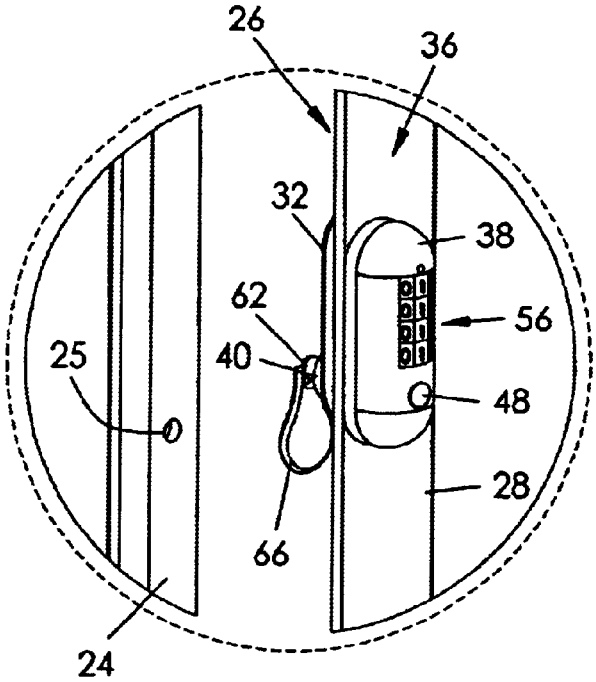
FIG. 2B is an isolated perspective view on an enlarged scale of the locking assembly shown in FIG. 2A.
Figure 2A:
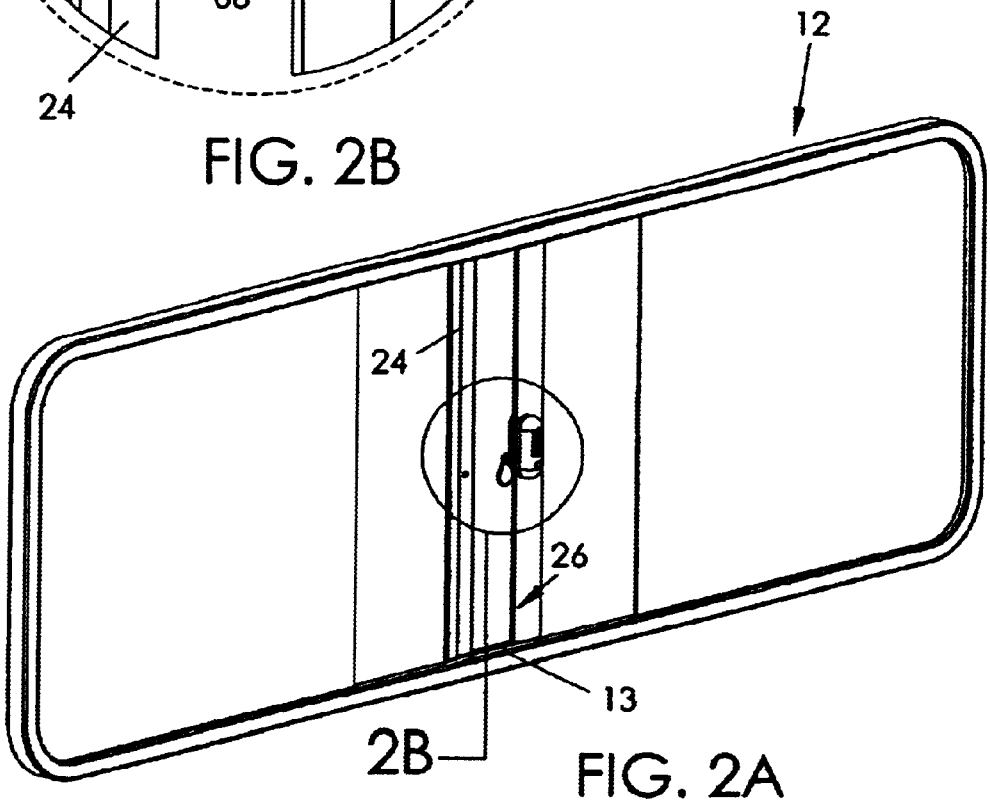
FIG. 2A is a perspective view of the apparatus as in FIG. 1 with the window units in an open configuration.
Figure 3B:
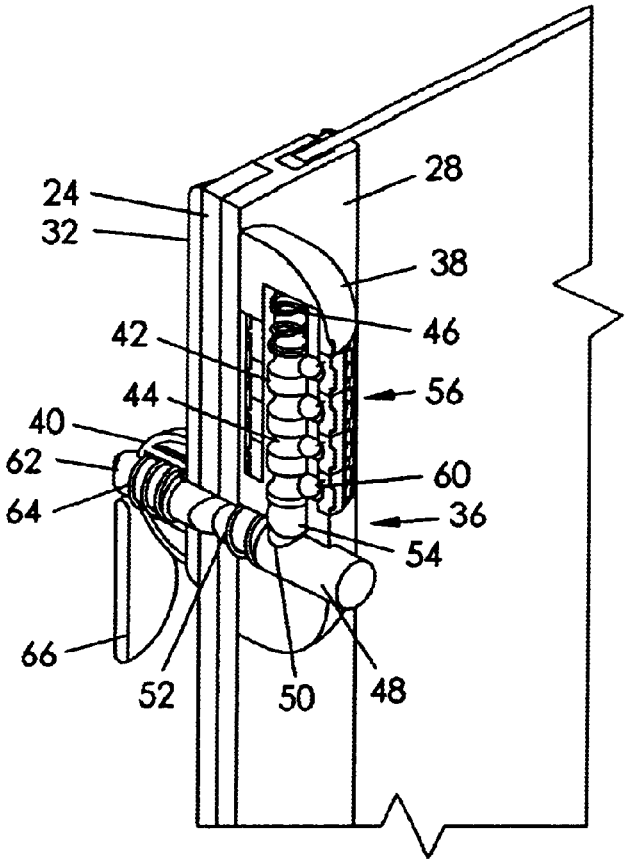
FIG. 3B is a sectional view taken along line 3B—3B of FIG. 3A.
Figure 3A:
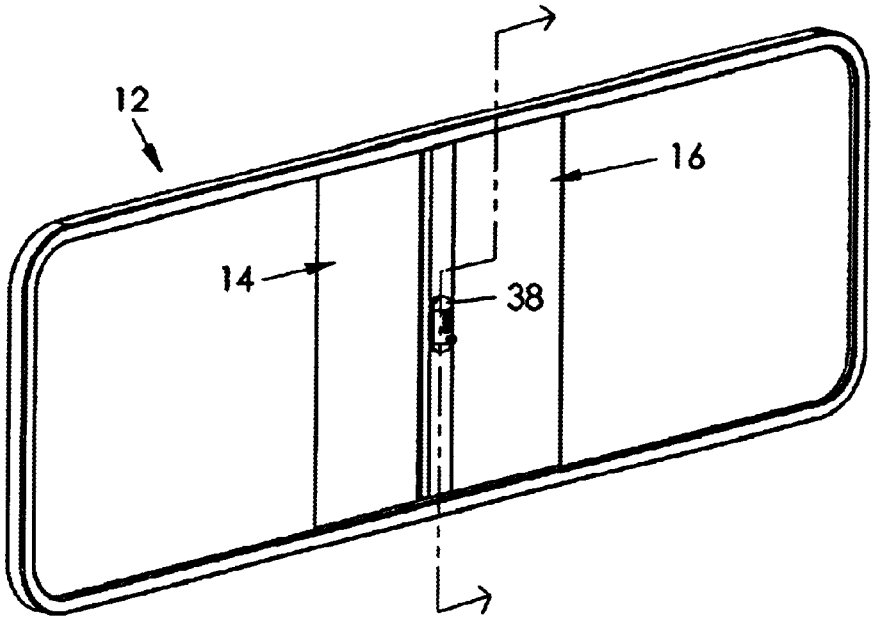
FIG. 3A is a perspective front view of the apparatus as in FIG. 1.
Figure 4A:
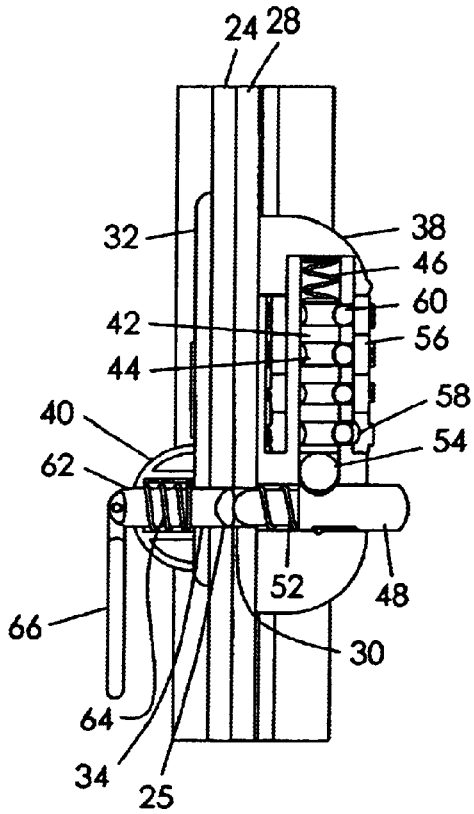
FIG. 4A is a side view of the locking assembly shown in FIG. 3B in a locked configuration.

Respective secondary window frames include first 24 and second 26 vertical frame members. The vertical frame members are configured to be superimposed over one another when the window units are moved to a closed configuration. More particularly, the second vertical frame member 26 includes an outer segment 28 and an inner segment 32 joined together to form a channel having a female configuration capable of receiving the first vertical frame member 24 therein (FIG. 3B). Therefore, the first vertical frame member 24 is essentially captured by the second vertical frame member 26 at the closed configuration. It should be observed that the inner segment 32 is only necessary relative to the locking assembly, as to be described more fully below. Inner 32 and outer 28 segments of the second vertical frame member 26 define through-holes 34, 30, respectively (FIG. 4A). In addition, the first vertical frame member 24 defines a through-hole 25 (FIG. 2B). When the first 14 and second 16 window units are at the closed (mated) configuration, all of the through-holes are in alignment for use as to be described below.

The lockable sliding window apparatus 10 includes a locking assembly 36 for preventing unauthorized opening of the windows from the outside. More particularly, the locking assembly 36 includes a primary lock housing 38 fixedly attached to the outer segment 28 of the second vertical frame member 26 and a secondary lock housing 40 fixedly attached to the inner segment 32 thereof (FIG. 3B).

Figure 4B:
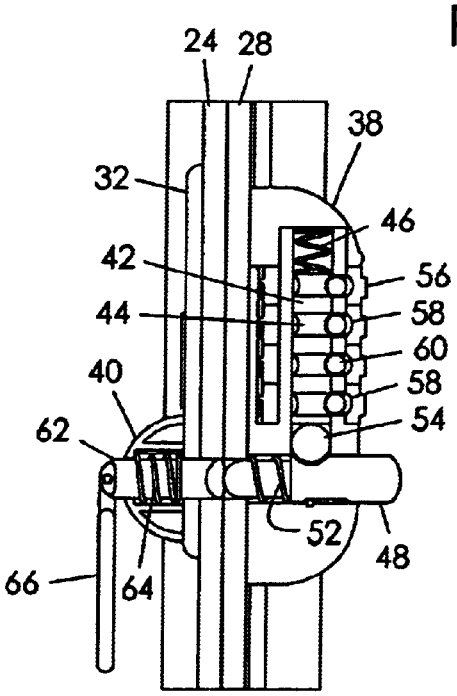
FIG. 4B is a side view of the locking assembly shown in FIG. 3B in an unlocked configuration.

The primary lock housing 38 includes a dial-type combination lock mechanism having a dial pin 42 positioned in an interior space of the primary lock housing 38 and being urged downward by a coil spring 46 (FIG. 3B). A lock pin 48 extends through the primary lock housing 38 generally perpendicular to the dial pin 42, the lock pin 48 defining a recess 50 therein. A lock ball 54 is positioned intermediate the dial pin 42 and lock pin 48 and is normally urged to engage the lock pin recess 50. The combination lock mechanism includes a plurality of dials 56 mounted for rotation about the dial pin 42, each dial defining a dial pocket 58 (FIG. 4B). It is understood that each dial 56 includes an indicium and may be manipulated by a user when setting the dials 56 to an appropriate "unlock" code. It is further understood that each dial pocket 58 corresponds to a predetermined code indicium.

Figure 4C:
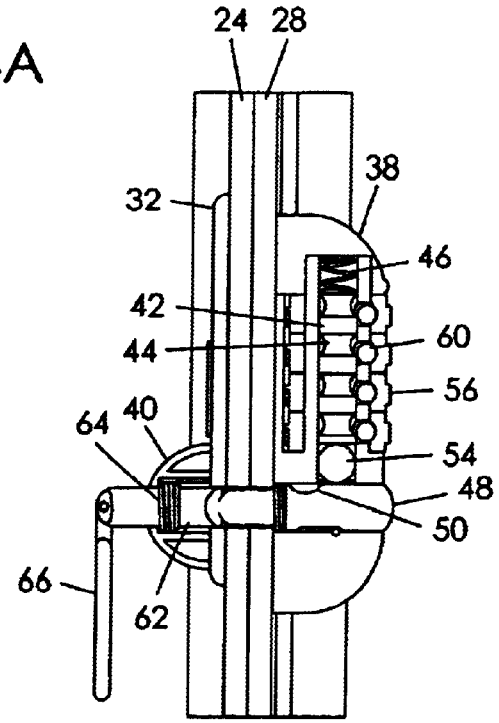
FIG. 4C is a side view of the locking assembly shown in FIG. 3B in an unlocked configuration and with the lock pin depressed.
Figure 5B:
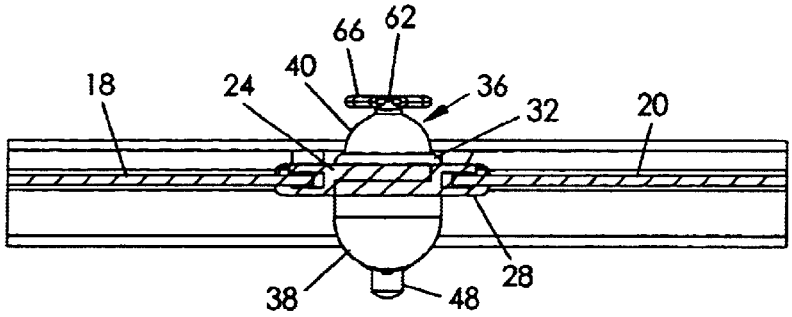
FIG. 5B is a sectional view taken along line 5B—5B of FIG. 5A.
Figure 5A:
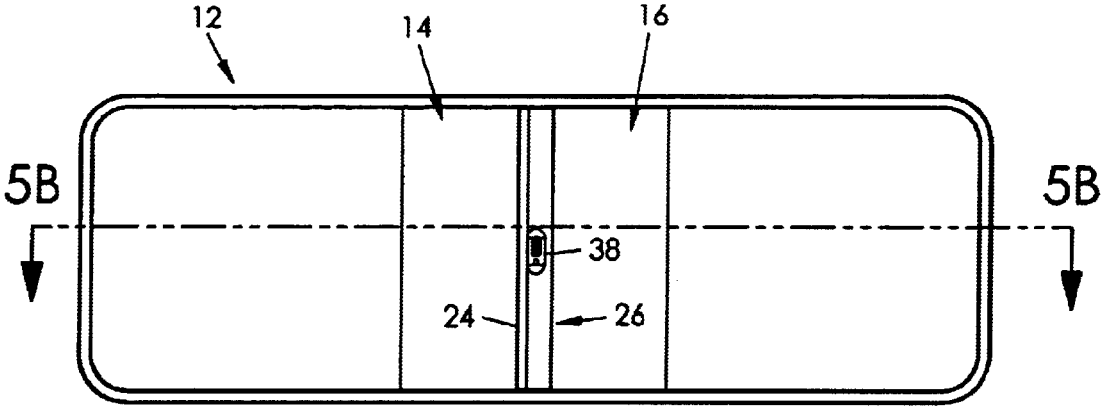
FIG. 5A is a front view of the apparatus as in FIG. 1.
Figure 6B:
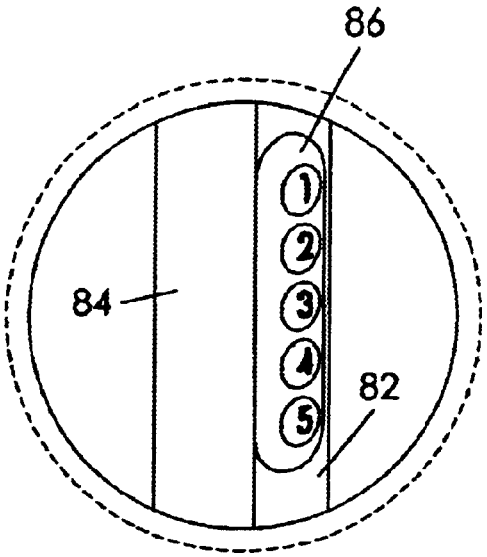
FIG. 6B is an isolated view of an electronic keypad of the apparatus as in FIG. 6A on an enlarged scale.
Figure 6A:
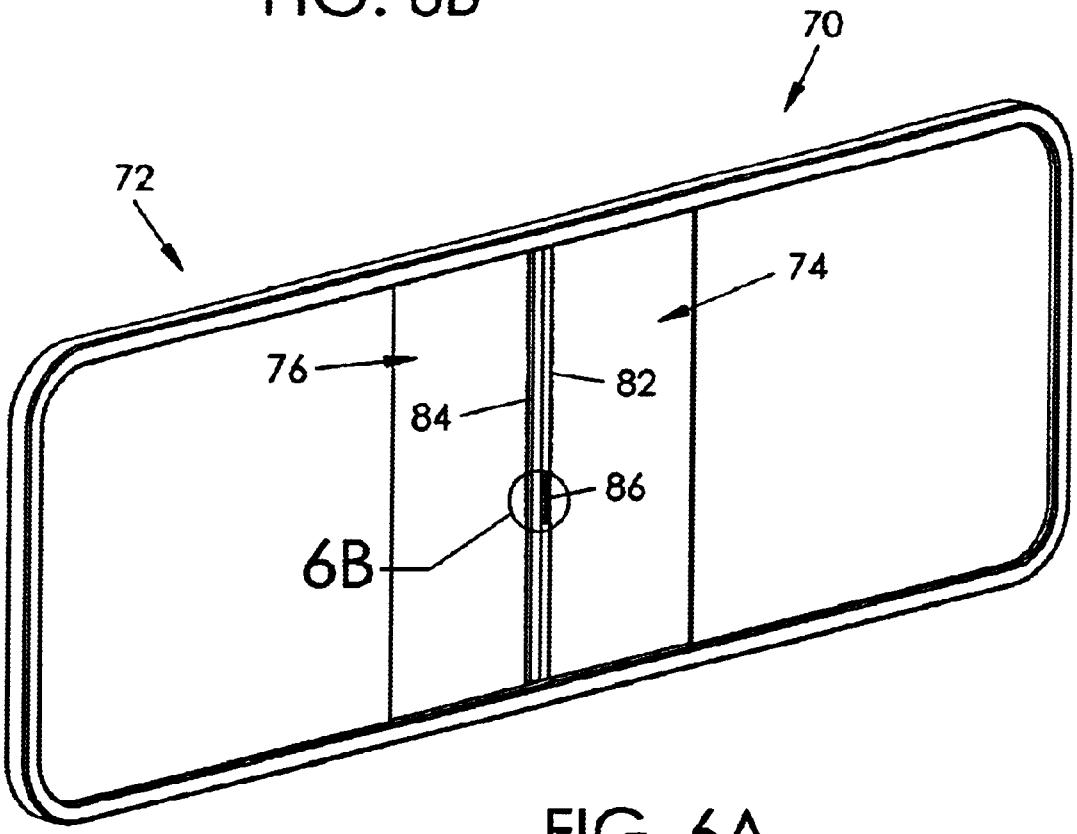
FIG. 6A is a front perspective view of a lockable sliding window apparatus according to another embodiment of the present invention.

The lock mechanism further includes a plurality of dial balls 60 situated intermediate respective dials 56 and the dial pin 42 (FIGS. 4A–4C). The dial balls 60 are captured within depressions 44 formed in the dial pin 42 such that the dial pin 42 is immovable (FIG. 4A). In other words, the combination lock mechanism is locked while the dial balls 60 are captured by the dial pin depressions 44. However, when a dial 56 is rotated to its respective code position, its dial pocket 58 becomes aligned with a corresponding dial ball 60 (FIG. 4B). Thereafter, a depression of the lock pin 48 pushes the lock ball 50 upwardly in a camming action, urging the dial pin 42 upwardly and compressing the spring 46. The dial balls 60 are shifted into respective dial pockets 58 by this action (FIG. 4C).

The lock pin 48 extends through the primary lock housing 38 generally perpendicularly to the dial pin 42 and adjacent to the lock ball 54. A spring 52 is coupled to an inner end of the lock pin 48 and biases it to extend outwardly through an outer surface of the primary lock housing 38 (FIG. 4A). The lock pin 448 extends through the outer segment through-hole 30. In its normal configuration, the lock pin recess 50 is aligned with the lock ball 54, the lock ball being urged to nest therein by the dial pin spring 46. Therefore, the lock pin 48 is immovable so long as the dial balls 60 are captured in the dial pin depressions 44 (FIG. 4A). However, when the combination lock mechanism is in its unlocked state (FIG. 4C), a user may depress the end of the lock pin 48 that extends from the primary lock housing 38 so as to extend the lock pin 48 through the through-holes 30, 25 of both the outer segment 28 of the second vertical frame member 26 and first vertical frame member 24, respectively. This action enables the first vertical frame member 24 to be released from the mating relationship with the second vertical frame member 26, as yet to be described more fully below. It should be appreciated that the inner end of the lock pin 48 presents a rounded configuration such that the first vertical frame member 24 can gently push past it with minimal resistance.

The secondary lock housing 40 is mounted to the inner segment 32 of the second vertical frame member 26 at a point covering the through-hole 34 defined thereby (FIG. 4A). A window pin 62 is positioned within the secondary lock housing 40 and urged inwardly toward the inner segment through-hole 34 by a compression spring 64. The inner end of the window pin 62 includes a tapered or draft angle such that the pin is moved outwardly (compressing the spring 64) when the first window unit 14 is moved from an open configuration to a closed configuration. In other words, open window units may be freely closed, the window pin 62 automatically springing through the inner segment and first vertical frame member through-holes when the window units arrive at the closed configuration. As all of the through-holes are in alignment, the window pin 62 and lock pin 48 have a common imaginary vertical axis. Once in this configuration, the window units may not be opened from the outside until the lock pin 48 is depressed to push the window pin 62 out of the first vertical frame member through-hole 25 (FIG. 4C).

The window pin 62 includes an outer end extending through an outer surface of the secondary lock housing 40 (FIG. 3B). A pull tab 66 is pivotally coupled to the outer end although a fixed attachment would also be suitable. The pull tab 66 enables a user to manually pull the window pin 62 out of the first vertical frame member through-hole 25, i.e. out of its locking configuration. This enables a user to essentially unlock the window units from the inside and freely slidably move the window units. The window pin spring 64 is compressed when the pull tab 66 is pulled and again urges the window pin 62 in the direction of the inner segment 32 when released.

In use as a rear window of a truck, a user may freely open and close the first 14 and second 16 window units from inside the vehicle. It is understood, of course, that once the window units are in the closed configuration, the pull tab 66 must be used to partially withdraw the window pin 62 to allow the first vertical frame member 24 to be released from the second vertical frame member 26. Thus, the window units 14, 16 are automatically locked when at the closed configuration. To unlock the window units from the outside, a user may rotate the dials 56 to a predetermined combination code. When properly rotated, the lock ball 54 and dial pin 42 are free to be shifted upwardly upon a user depression of the lock pin 48. A depression of the lock pin 48 causes the lock pin 48 to bear against the window pin 62 and push the window pin 62 out of the first vertical frame member through-hole 25. This releases the first vertical frame member 24 and allows the first window unit 14 to be opened. In this way, an authorized user may gain access to a vehicle without having to carry keys or other operational hardware.

A lockable sliding window apparatus 70 according to another embodiment of the present invention is shown in FIGS. 6 through 9B. This apparatus 70 includes a window frame 72 and first 74 and second 76 window units having a construction substantially similar to that of the embodiment first described above (FIG. 7A). The first 74 and second 76 window units include respective first 82 and second 84 vertically disposed frame members having corresponding configurations that bear against one another when the windows are slidably moved to a closed configuration. In fact, the vertical frame members may include a configuration and hardware to provide a seal therebetween at the closed configuration.

Figure 7B:
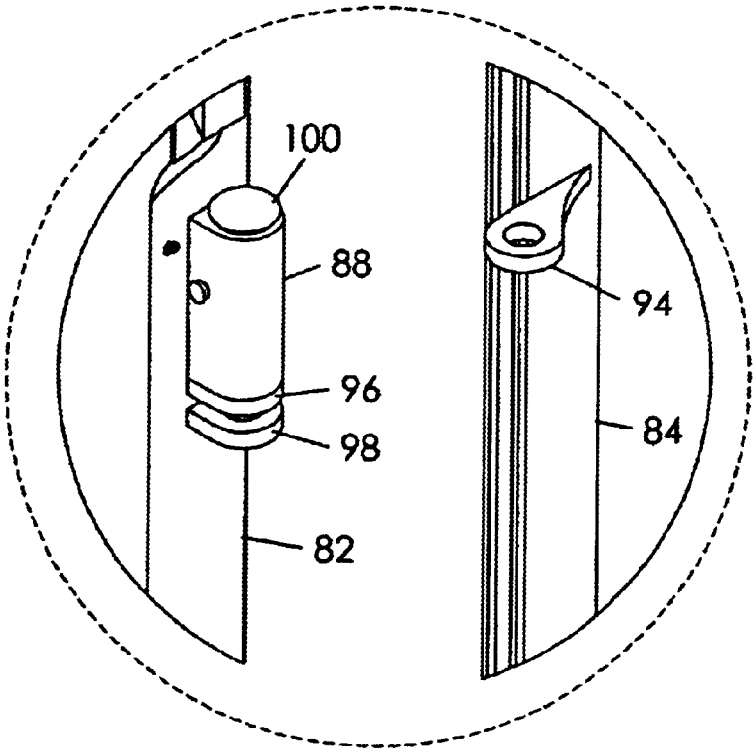
FIG. 7B is an isolated view of a solenoid and flanges of the apparatus as in FIG. 7A on an enlarged scale.
Figure 7A:
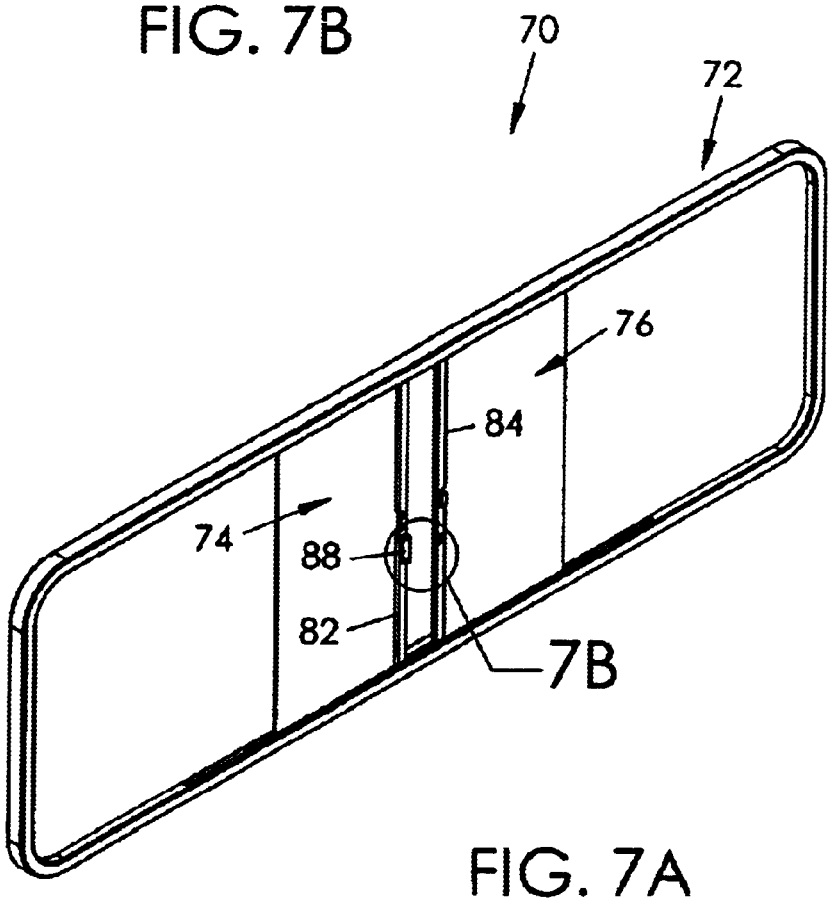
FIG. 7A is a rear perspective view of the apparatus as in FIG. 6A.
Figure 8B:
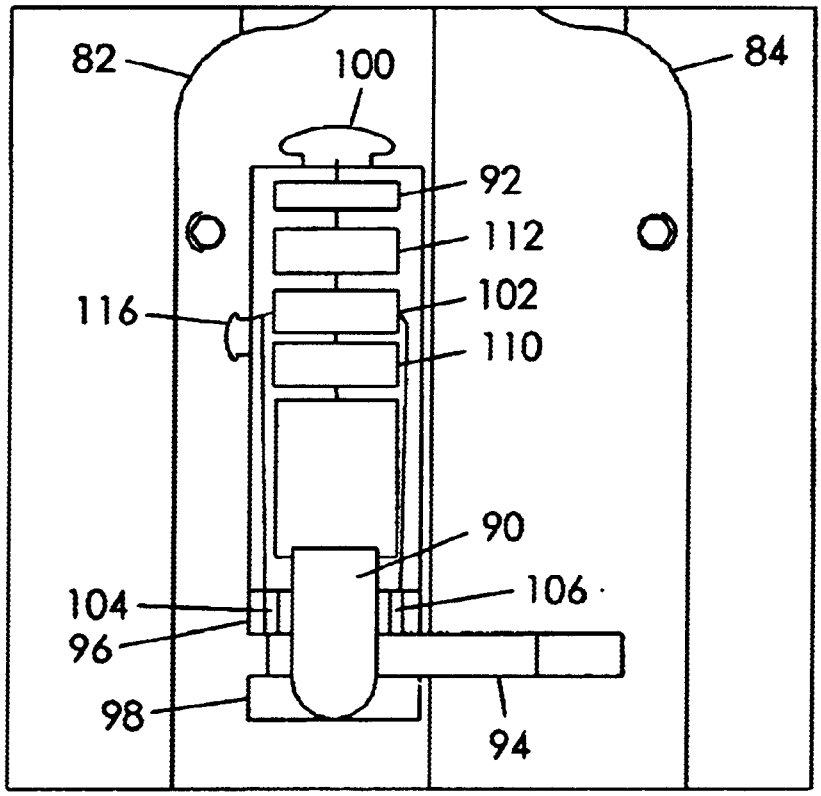
FIG. 8B is a sectional view taken along line 8B—8B of FIG. 8A.

The apparatus 70 according to this embodiment also includes a locking assembly. The locking assembly includes an electronic numeric keypad 86 mounted to a front surface of the first vertical frame member 82 for receiving a security code input by a user (FIG. 7B). Further, the locking assembly includes a solenoid module 88 mounted to a rear surface of the first vertical frame member 82, the solenoid module providing a housing in which a lock pin 90 is mounted for reciprocative movement between retracted and extended configurations (FIG. 8B). A battery 92 is also mounted within the solenoid module 88 that is electrically connected to the keypad 86 and lock pin 90.

Figure 8A:
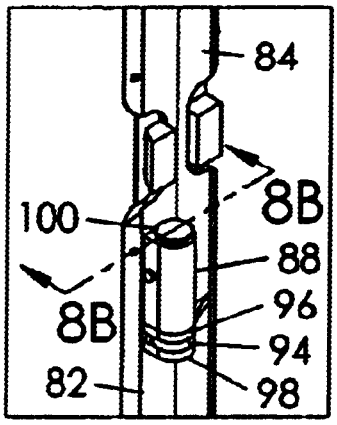
FIG. 8A is a fragmentary view of the apparatus as in FIG. 7B.
Figure 8C:
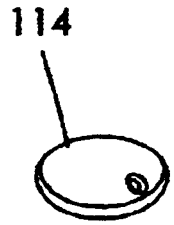
FIG. 8C is a perspective view of a transponder according to the invention shown in FIG. 6A.

A main flange 94 defining a through-hole is mounted to a rear surface of the second vertical frame member 84 and is positioned such that the through-hole is in vertical alignment with the lock pin 90 when the window units are at the closed configuration. More particularly, the main flange 94 is positioned adjacent an open bottom of the solenoid module housing when the window units are closed (FIGS. 8A and 8B). For added stability, auxiliary flanges 96, 98 may be positioned above and below the main flange 94 (FIG. 7B). The solenoid module is capable of moving the lock pin 90 between an extended configuration extending through the main flange through-hole and a retracted configuration not extending through the flange.

Comparator circuitry (not shown) is positioned within the solenoid module 88 and electrically connected to the battery 92, the comparator circuitry allowing current from the battery to energize the lock pin 90 to move from the extended/locked configuration to the retracted configuration when the input security code matches a predetermined security code. Therefore, when the window units 74, 76 are in the closed configuration and the predetermined security code is input, the lock pin 90 retracts through the flange through-hole so as to unlock the window units.

Further, a lock button 100 is coupled to a top of the solenoid module 88 and may be manually depressed or retracted. The lock button 100 is electrically connected to the battery 92 such that button depression enables current to flow from the battery 92 to the lock pin 90 so as to energize the lock pin 90 to move from the retracted configuration to the extended configuration. Similarly, retraction of the lock button 100 energizes the lock pin 90 to return to the retracted configuration. Therefore, the lock button 100 allows the window units 74, 76 to be locked or unlocked by a user from the inside of the window frame 72.

Further, the solenoid module 88 may include a logic circuit 102 positioned within the solenoid housing and electrically connected to the battery 92. It is understood that the logic circuit 102 may include the comparator circuitry described previously although the comparator circuitry may be included separately and electrically connected to the logic circuit 102.

A pair of sensors may be mounted to a bottom of the upper auxiliary flange 96 although it is understood that they may be mounted to a bottom of the solenoid module housing if the auxiliary flanges 96, 98 are not included (FIG. 8B). Each sensor is a touch sensor for detecting contact with the main flange 94 although a proximity sensor would also work. More particularly, a first sensor 104 is positioned on the bottom of the upper auxiliary flange 96 to the distal/far side of an upper auxiliary flange aperture relative to the second vertical frame member 84. In other words, the first sensor 104 is not contacted by the main flange 94 until the main flange 94 is substantially aligned to receive the lock pin 90 (FIG. 8B). When contact is sensed, the first sensor 104 generates a first output signal and conveys it to the logic circuit 102. Thereafter, the logic circuit 102 may energize the lock pin 90 to move to the extended configuration. Thus, the windows are automatically locked when closed.

Figure 9A:
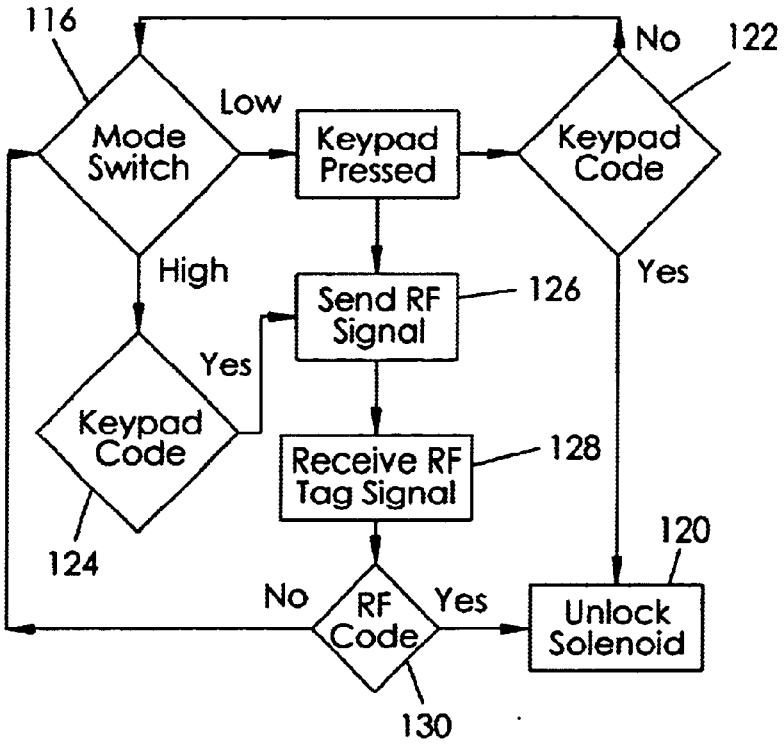
FIG. 9A is a flowchart illustrating the logic performed by a logic circuit according to the invention of FIG. 6A.
Figure 9B:
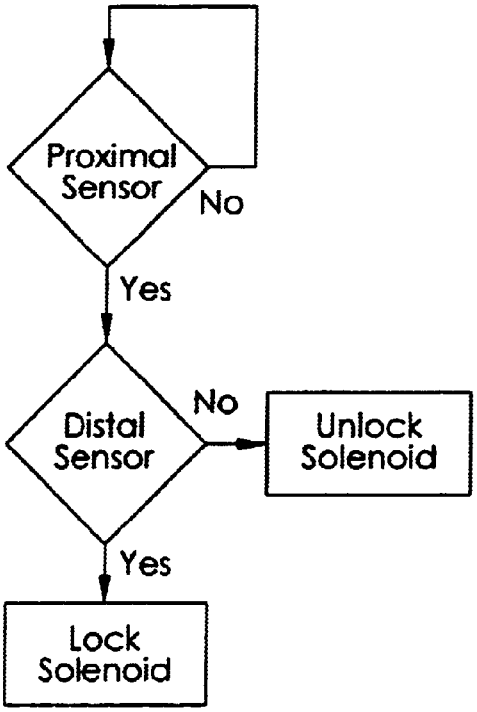
FIG. 9B is a flowchart illustrating additional logic performed by the logic circuit according to the invention shown in FIG. 6A.

A second sensor 106 is positioned on the bottom of the upper auxiliary flange 96 to the proximal/near side of the upper auxiliary flange aperture. In other words, the second sensor 106 may be contacted as the main flange 94 is moving toward alignment with the lock pin 90 but the vertical frame members are not yet in a closed configuration. When contact is sensed, the second sensor 106 generates a second output signal and conveys it to the logic circuit 102 which, in turn, energizes the lock pin 90 to move to the retracted configuration. Therefore, the second sensor 106 ensures that the lock pin 90 is out of the way to allow closure of the window units. The logic of the operation of the proximal/second 98 and distal/first 96 touch sensors is illustrated in FIG. 9B.

Further, the solenoid module 88 may include radio frequency identification (RFID) components. More particularly, a transceiver 110 and an antenna 112 are positioned within the solenoid module housing and are electrically connected to the logic circuit 102 and battery 92 (FIG. 8B). Preferably, the transceiver 110 is packaged with its own decoder circuitry although the decoder may be included in the logic circuit 102. Together, the transceiver 110 with decoder and antenna 112 may be referred to as an interrogator. The RFID components also include a transponder 114 separate from the solenoid module 88 (FIG. 8C) that may be conveniently carried by a user. The transponder 114 may take the form of a smart card, sticker, token, etc.

In function, the transceiver 110 transmits an electromagnetic field at a predetermined radio frequency. The range of this field depends upon the power output and radio frequency used. When the transponder 114 is within range, it receives the transmitted waves and returns an identification signal. Preferably, the transponder 114 is a passive tag which obtains sufficient operating power from the transmitted wave itself and needs no additional power source. However, an active-type transponder would also work but would require its own power source, such as a battery. The return signal is received by the antenna 112 and decoded so as to determine if the transponder 114 corresponds to an authorized user. If so, then the logic circuit 102 is adapted to energize the solenoid module 88 to unlock the window units, as previously described.

The solenoid module 88 includes a mode switch 116 electrically connected to the logic circuit 102 for toggling between two modes/levels of security. In one mode, the logic circuit 102 energizes the solenoid module 88 to unlock the lock pin 90 solely upon entry of the predetermined security code, as indicated by reference numerals 120, 122, respectively, in FIG. 9A. In another mode, entry of the correct security code 124 is first required. Then, the transceiver 110 sends out a radio frequency (RF) signal and receives a return signal from the transponder 114 as indicated at 126 and 128, respectively. If the return signal is recognized as being authorized 130, then the solenoid module 88 is energized to unlock 120.

It is understood that while certain forms of this invention have been illustrated and described, it is not limited thereto except insofar as such limitations are included in the following claims and allowable functional equivalents thereof.

Having thus described the invention, what is claimed as new and desired to be secured by Letters Patent is as follows:

1. A lockable sliding window apparatus, comprising:

a window frame;

first and second window units mounted in said window frame, at least said first window unit being mounted in said window frame for horizontal sliding movement between open and closed configurations, said first and second window units including respective first and second secondary frames in which respective window panels are mounted;

wherein said first secondary frame includes a first vertical frame member having a male configuration and said second secondary frame includes a second vertical frame member having a female configuration with inner and outer segments for receiving said first vertical frame member at said closed configuration;

wherein said first vertical frame member and said inner an outer segments of said second vertical frame member define corresponding through-holes;

a locking assembly having a primary lock housing fixedly attached to said outer segment of said second vertical frame member and a secondary lock housing fixedly attached to said inner segment of said second vertical frame member, said locking assembly further comprising:

a dial pin positioned in said primary lock housing;

a plurality of combination dials mounted in said primary lock housing for rotation about said dial pin, each combination dial defining a ball pocket;

a plurality of dial balls situated between respective combination dials and said dial pin, each dial ball being capable of movement into a corresponding ball pocket when rotatably aligned;

a lock pin positioned in said primary lock housing perpendicular to said dial pin and aligned with said first segment through-hole, said lock pin being outwardly spring-biased and horizontally slidable in said primary housing, said lock pin defining a lock pin recess;

a lock ball situated between said lock pin and an end of said dial pin, said dial pin being spring-biased for urging said lock ball into said lock pin recess;

a window pin positioned in said secondary lock housing and aligned with said second segment through-hole, said window pin being inwardly spring-biased and horizontally slidable in said secondary lock housing;

whereby said lock ball engages said lock pin recess and prevents movement thereof when said combination dials are in a locked configuration and said lock pin may be depressed for urging said window pin outwardly when said combination dials are in an unlocked configuration.

2. The lockable sliding window apparatus as in claim 1, wherein said window frame includes a guide rail extending longitudinally therealong, said first window unit being mounted to said guide rail for horizontal slidable movement therealong.

3. The lockable sliding window apparatus as in claim 2 wherein said first and second window units are mounted to said guide rail for horizontal slidable movement therealong.

4. The lockable sliding window apparatus as in claim 1 wherein said window pin is normally biased to extend through said first vertical frame member through-hole for preventing slidable movement of said first window unit at said closed configuration.

5. The lockable sliding window apparatus as in claim 4 further comprising a pull tab connected to said window pin for selectively moving said window pin out of said first vertical frame member through-hole such that said first window unit may be slidably moved to said open configuration.

6. The lockable sliding window apparatus as in claim 1 wherein longitudinal axis extends through said window pin and said lock pin.

7. The lockable sliding window apparatus as in claim 1 wherein said lock pin is spring-biased such that one end thereof normally extends outwardly from through a front surface of said primary lock housing.

8. A lockable sliding window apparatus, comprising:

a window frame;

first and second window units mounted in said window frame, at least said first window unit being mounted in said window frame for horizontal sliding movement between open and closed configurations, said first and second window units including respective first and second secondary frames in which respective window panels are mounted;

wherein said first secondary frame includes a first vertical frame member having a male configuration and said second secondary frame includes a second vertical frame member having a female configuration with inner and outer segments for receiving said first vertical frame member at said closed configuration;

wherein said first vertical frame member and said inner and outer segments of said second vertical frame member define corresponding through-holes;

a primary locking assembly coupled to said outer segment of said second vertical frame member, said primary locking assembly having a combination dial lock mechanism and a lock pin in communication with said combination dial lock mechanism and that is slidably movable between an immovable configuration when said combination dial lock mechanism is locked and a slidably movable configuration in which said lock pin may be selectively extended through said through-holes of said outer segment and said first vertical frame member when said combination dial lock mechanism is unlocked;

a secondary locking assembly coupled to said inner segment of said second vertical frame member, said secondary locking assembly having a window pin that is spring-loaded to extend through said through-holes of said outer segment and said first vertical frame member at said closed configuration, said lock pin adapted to selectively urge said window pin out of said through-holes of said outer segment and said first vertical frame member when said lock pin is at said movable configuration; and whereby said first vertical frame member may be selectively moved from said closed configuration to said open configuration when said window pin is urged out of said: through-holes of said outer segment and said first vertical frame member.

9. The lockable sliding window apparatus as in claim 8 wherein said window frame includes a guide rail extending longitudinally therealong, said first window unit being mounted to said guide rail for horizontal slidable movement therealong.

10. The lockable sliding window apparatus as in claim 8 further comprising a pull tab connected to said window pin for selectively urging said window pin out of said first vertical frame member through-hole upon a user operation thereof such that said first window unit may be slidably moved from said closed configuration to said open configuration.

11. The lockable sliding window apparatus as in claim 8 wherein longitudinal axis extends through said window pin and said lock pin.

12. The lockable sliding window apparatus as in claim 8 wherein said lock pin is spring-biased such that one end thereof is urged outwardly from said primary locking assembly.

13. A lockable sliding window apparatus, comprising:

a window frame;

first and second window units mounted in said window frame, at least said first window unit being mounted in said window frame for horizontal sliding movement between open and closed configurations, said first and second window units including respective first and second secondary frames in which respective window panels are mounted;

wherein said first and second secondary frames include respective first and second vertical frame members adapted to bear against one another at said closed configuration;

a locking assembly, comprising:

an electronic keypad mounted to a front surface of said first vertical frame member for receiving a manually input security code;

a solenoid module mounted to a rear surface of said first vertical frame member, said solenoid module having a lock pin adapted to move between a retracted configuration and an extended configuration;

a flange mounted to a rear surface of said second vertical frame member and defining a through-hole, said through-hole being aligned with said lock pin when said window units are at said closed configuration;

comparator circuitry connected to said keypad and to said solenoid module for comparing said input security code with a predetermined security code, said comparator circuitry adapted to energize said lock pin to move from said retracted configuration to said extended configuration when said input security code matches said predetermined security code.

14. The lockable sliding window apparatus as in claim 13 wherein said solenoid module includes a battery electrically connected to said keypad, said comparator circuitry, and said lock pin.

15. The lockable sliding window apparatus as in claim 14 further comprising a lock button coupled to said solenoid module, said lock button being electrically connected to said battery and said lock pin for selectively actuating said lock pin.

16. The lockable sliding window apparatus as in claim 14 further comprising:

a logic circuit positioned in said solenoid module and electrically connected to said battery;

a transceiver electrically connected to said logic circuit for selectively transmitting a radio frequency query signal;

a transponder separate from said locking assembly for returning an identification signal in response to said query signal, said transceiver adapted to receive said identification signal; and means in said logic circuit for analyzing said identification signal and for energizing said lock pin to move from said extended configuration to said retracted configuration if said identification signal matches a predetermined identification signal.

17. The lockable sliding window apparatus as in claim 16 wherein said transponder is a passive RFID tag having a construction that obtains operational power from said query signal.

18. The lockable sliding window apparatus as in claim 14 further comprising:

a logic circuit positioned in said solenoid module and electrically connected to said battery;

a transceiver electrically connected to said logic circuit for selectively transmitting a radio frequency query signal;

a transponder separate from said locking assembly for returning an identification signal in response to said query signal, said transceiver adapted to receive said identification signal; and means in said logic circuit for analyzing said identification signal and for energizing said lock pin to move from said extended configuration to said retracted-configuration if said identification signal matches a predetermined identification signal and said input security code matches said predetermined security code.

19. The lockable sliding window apparatus as in claim 13 further comprising:

a first sensor mounted to said solenoid module for sensing contact with said flange, said first sensor generating a first output signal upon sensing contact with said flange;

a logic circuit positioned in said solenoid module and electrically connected to said first sensor and to said comparator circuitry, said logic circuit including means for energizing said lock pin to move from said retracted configuration to said extended configuration upon receipt of said first output signal.

20. The lockable sliding window apparatus as in claim 19 further comprising:

a second sensor mounted to said solenoid module and electrically connected to said logic circuit for sensing contact with said flange, said second sensor generating a second output signal upon sensing contact with said flange; and means in said logic circuit for energizing said lock pin to move from said extended configuration to said retracted configuration upon receipt of said second output signal.

* * * * *